US007614910B2

(12) United States Patent
Croteau et al.

(10) Patent No.: US 7,614,910 B2
(45) Date of Patent: Nov. 10, 2009

(54) ELECTRICAL CONNECTOR

(75) Inventors: David Croteau, St-Jean-sur-Richelieu (CA); Pierre-Samuel Bricteux, Verdun (CA); Danny Dupuis, Sainte-Julie (CA); Stephane Poulin, Sainte-Julie (CA)

(73) Assignee: TM4 Inc.

( * ) Notice: Subject to any disclaimer, the term of this patent is extended or adjusted under 35 U.S.C. 154(b) by 2 days.

(21) Appl. No.: 12/125,322

(22) Filed: May 22, 2008

(65) Prior Publication Data

US 2009/0130898 A1 May 21, 2009

Related U.S. Application Data

(60) Provisional application No. 60/924,616, filed on May 23, 2007.

(51) Int. Cl.
*H01R 13/73* (2006.01)

(52) U.S. Cl. ..... 439/573; 439/559

(58) Field of Classification Search ..... 439/550–567, 439/569–573

See application file for complete search history.

(56) References Cited

U.S. PATENT DOCUMENTS

| | | | | |
|---|---|---|---|---|
| 3,388,211 | A | 6/1968 | Nichols et al. | |
| 4,226,432 | A | 10/1980 | Nakamizo | |
| 4,472,012 | A | 9/1984 | Michaels | |
| 4,626,721 | A | 12/1986 | Ouchi | |
| 4,676,575 | A | 6/1987 | Denlinger et al. | |
| 4,743,210 | A * | 5/1988 | Schild et al. | 439/559 |
| 5,417,587 | A * | 5/1995 | Katsuda et al. | 439/559 |
| 5,649,834 | A | 7/1997 | Allison et al. | |
| 5,743,756 | A | 4/1998 | Hasz et al. | |
| 5,752,852 | A * | 5/1998 | Onoda | 439/559 |
| 6,152,745 | A * | 11/2000 | Matsumoto et al. | 439/98 |
| 6,422,899 | B1 * | 7/2002 | Miyazaki | 439/559 |
| 6,464,538 | B2 * | 10/2002 | Miyazaki et al. | 439/607.44 |
| 6,485,332 | B1 | 11/2002 | Kwang | |
| 6,583,352 | B2 * | 6/2003 | Fukushima et al. | 174/373 |
| 6,595,789 | B2 * | 7/2003 | Oota et al. | 439/98 |
| 6,655,989 | B1 * | 12/2003 | Gale et al. | 439/559 |
| 6,702,612 | B2 * | 3/2004 | Miyazaki et al. | 439/559 |
| 6,716,071 | B2 * | 4/2004 | Miyazaki | 439/859 |
| 6,814,617 | B2 * | 11/2004 | Oota et al. | 439/589 |
| 6,837,728 | B2 | 1/2005 | Miyazaki et al. | |
| 6,864,426 | B2 | 3/2005 | Miyazaki | |
| 6,921,292 | B2 | 7/2005 | Miyazaki | |
| 6,945,817 | B2 | 9/2005 | Miyazaki et al. | |
| 6,953,357 | B2 * | 10/2005 | Fukushima et al. | 439/271 |
| 7,041,907 | B2 * | 5/2006 | Miyazaki | 174/72 A |
| 7,070,449 | B2 * | 7/2006 | Miyazaki | 439/587 |
| 7,094,098 | B2 * | 8/2006 | Miyazaki | 439/559 |
| 7,097,498 | B2 * | 8/2006 | Miyazaki | 439/559 |
| 7,101,217 | B2 * | 9/2006 | Hayashi | 439/447 |
| 7,150,631 | B2 * | 12/2006 | Reed et al. | 439/34 |

(Continued)

*Primary Examiner*—Ross N Gushi
(74) *Attorney, Agent, or Firm*—Fay Kaplun & Marcin, LLP

(57) ABSTRACT

Described are electrical connectors for hi-power applications where multiple electrical wires are to be maintained apart and electrically insulated from one another. The connectors are to be used to mount the plurality of wires to a receptacle of a casing so as to establish a connection with electric circuit(s) provided inside the casing. Portions of the connector interact with the casing to provide a seal therebetween to prevent the water and dirt infiltration inside the casing.

15 Claims, 9 Drawing Sheets

U.S. PATENT DOCUMENTS

| | | | | |
|---|---|---|---|---|
| 7,165,995 | B2 * | 1/2007 | Fukushima et al. | 439/607.58 |
| 7,329,145 | B2 * | 2/2008 | Yagome et al. | 439/556 |
| 7,393,218 | B1 * | 7/2008 | Pavlovic et al. | 439/97 |
| 7,488,905 | B2 * | 2/2009 | Kiely et al. | 174/666 |
| 7,534,138 | B1 * | 5/2009 | Gump et al. | 439/564 |
| 7,540,775 | B2 * | 6/2009 | Eckel et al. | 439/587 |
| 2001/0005642 | A1 * | 6/2001 | Sawayanagi | 439/34 |
| 2001/0012727 | A1 * | 8/2001 | Morlesin et al. | 439/559 |
| 2002/0048994 | A1 * | 4/2002 | Oota et al. | 439/607 |
| 2002/0132522 | A1 * | 9/2002 | Miyazaki et al. | 439/559 |
| 2004/0106325 | A1 * | 6/2004 | Miyazaki | 439/607 |
| 2004/0144557 | A1 | 7/2004 | Miyazaki | |

* cited by examiner

ELECTRICAL CONNECTOR

PRIORITY CLAIM

This application claims the benefit of U.S. Provisional Patent Application Ser. No. 60/924,616 filed on May 23, 2007, the specification of which is expressly incorporated herein, in its entirety, by reference

FIELD

The present invention relates to electrical connectors. More specifically, the present invention is concerned with electrical connectors used to mount one or many wires to a casing for their interconnection to elements provided inside the casing.

BACKGROUND

Electrical connectors used to interconnect many wires to a casing are known. Such conventional connectors generally use independent or integrally formed O-rings to provide an adequate seal between the connector and the casing. This is detrimental since it implies the use of more parts or more complex molds to produce the connector.

DETAILED DESCRIPTION

Figure 1:
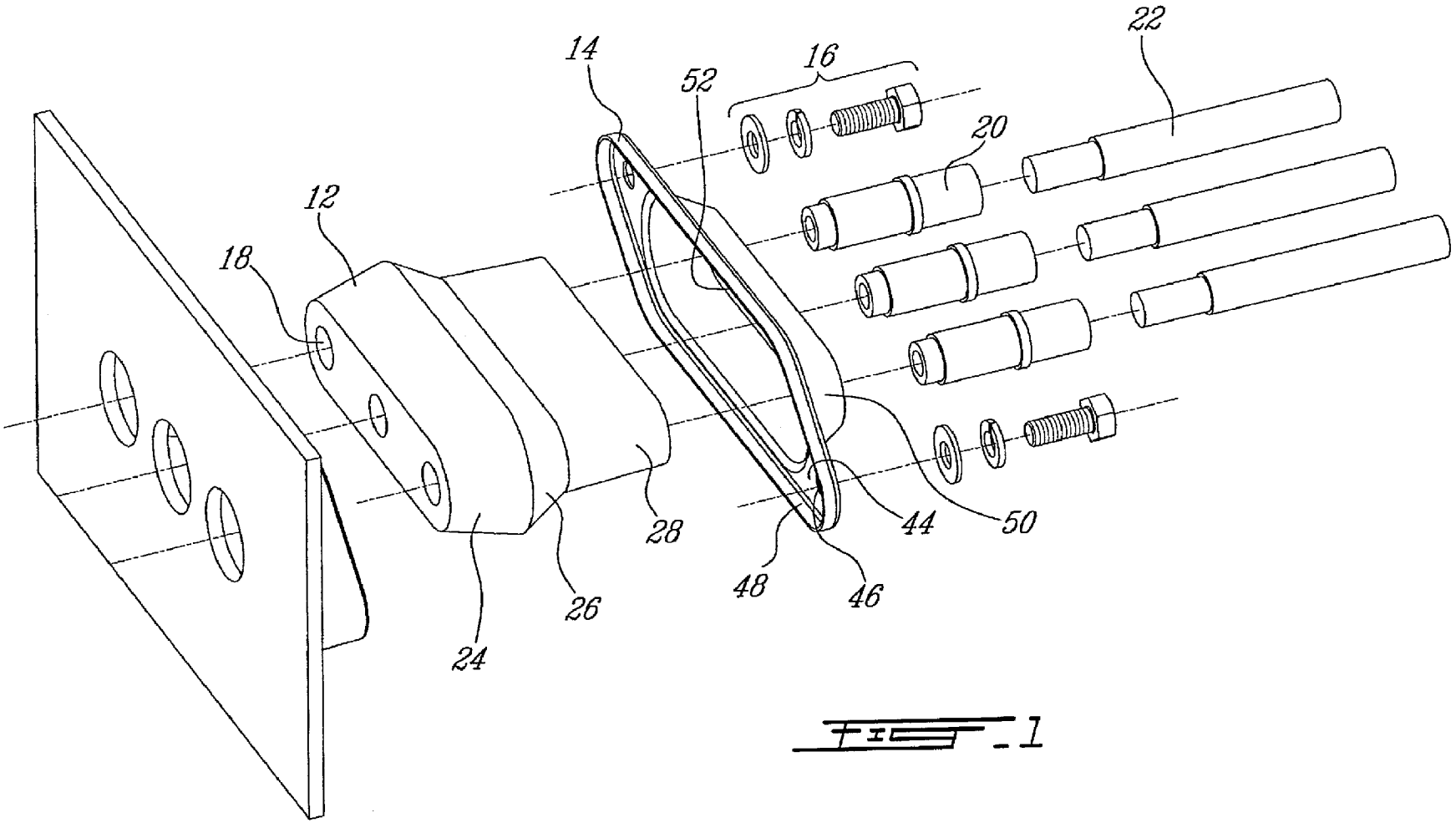
FIG. 1 is an exploded perspective view of a connector according to a first illustrative embodiment of the present invention.

In accordance with an illustrative embodiment of the present invention, there is provided an electrical connector to be connected to a receptacle of a casing; the receptacle including a cavity provided with a sloping inner wall, the electrical connector comprising:

a body including at least one aperture to receive a respective electric wire therethrough; a first taper portion and a second taper portion; the first taper portion being configured and sized as to snugly fit in the cavity of the receptacle;

a cover including a flat portion and a taper portion so configured and sized as to fit onto the second taper portion of the body;

at least one fastener assembly configured and sized to removably secure the flat portion of the cover to the casing.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

Other objects, advantages and features of the present invention will become more apparent upon reading of the following non-restrictive description of illustrative embodiments thereof, given by way of example only with reference to the accompanying drawings.

Generally stated, illustrative embodiments of the present invention are concerned with electrical connectors for hi-power applications where multiple electrical wires are to be maintained apart and electrically insulated from one another. The connectors are to be used to mount the plurality of wires to a receptacle of a casing so as to establish a connection with electric circuit(s) provided inside the casing. Portions of the connector interact with the casing to provide a seal therebetween to prevent the water and dirt infiltration inside the casing.

Turning now to FIGS. 1 to 5 a connector 10 according to a first illustrative embodiment of the present invention will be described.

The connector 10 includes a body 12, a cover 14 and two fastener assemblies 16. The body 12 includes three apertures 18 so configured and sized as to snugly receive lugs 20 to which electric wires or cables 22 are fixedly mounted.

The body 12 includes a first taper portion 24, a second taper portion 26 and a straight portion 28.

Figure 2:
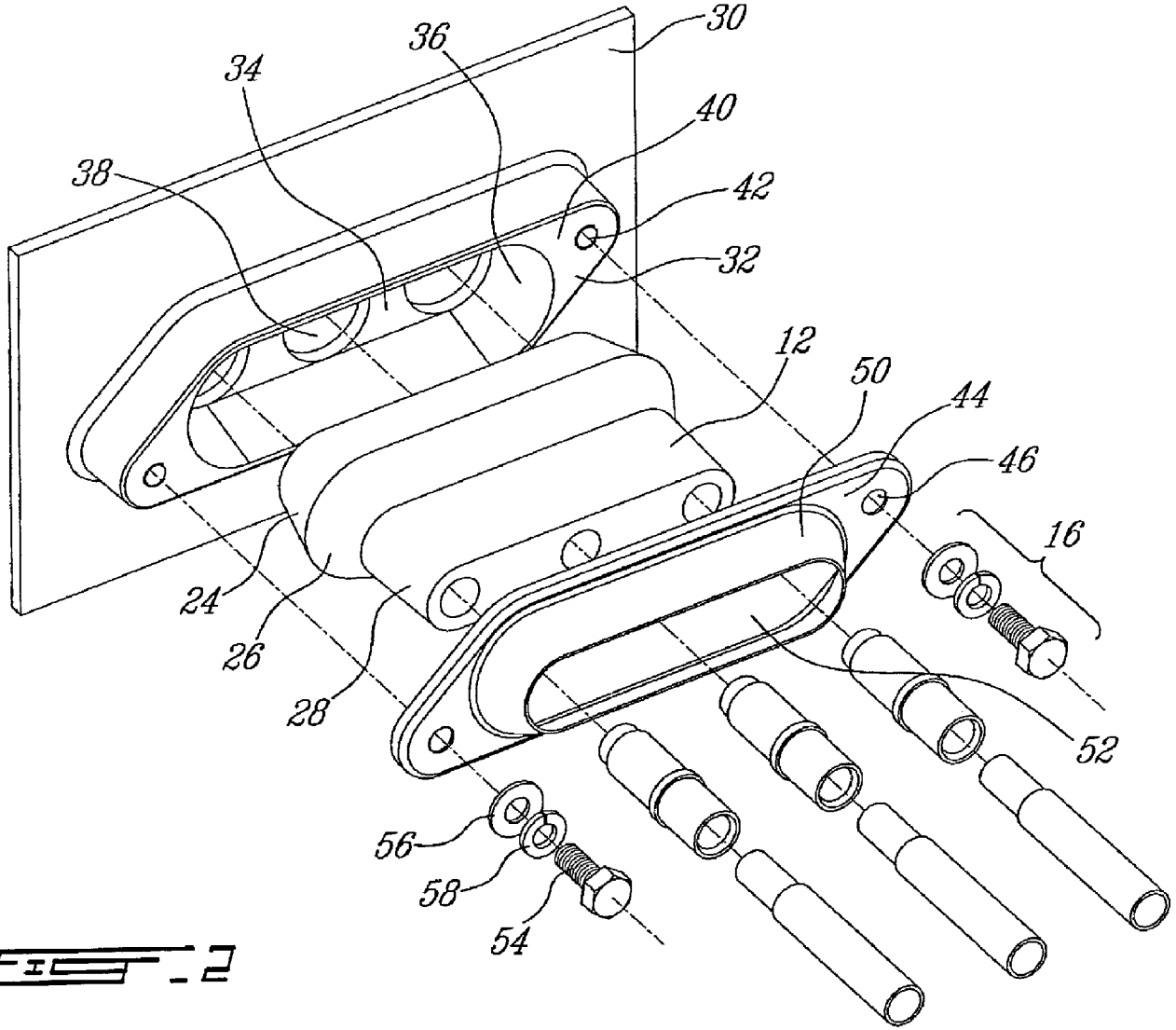
FIG. 2 is an exploded perspective view of the connector of FIG. 1.

As can be better seen from FIG. 2, the connector 10 is designed to be mounted to a casing 30 which includes a receptacle 32 so configured and sized as to receive the first taper portion 24 of the body 12. More specifically, the receptacle 32 includes a cavity 34 provided with a sloping inner wall 36 generally conforming to the first taper portion 24. The cavity 34 also includes three apertures 38 allowing pins (not shown) therethrough for interconnection with the lugs 20. The pins are connected to the electric circuit(s) (not shown) provided in the casing 30. Finally, the receptacle includes a flat portion 40 provided with threaded apertures 42 receiving portions of the fastener assemblies 16 as will be described hereinbelow.

Returning to FIG. 1, the cover 14 includes a flat portion 44 provided with two apertures 46 to allow passage of the fastener assemblies 16 and a flange portion 48. The cover 14 also includes a taper portion 50 so configured and sized as to fit onto the second taper portion 26 of the body 12. The taper portion 50 includes an aperture 52 to allow passage of the straight portion 28 of the body 12 therethrough.

Returning to FIG. 2, the fastener assemblies 16 include a fastener 54, a flat washer 56 and a lock washer 58. The fastener 54 is so configured and sized as to go through the lock washer 58, the flat washer 54, the aperture 46 and to thread into the threaded aperture 42 of the receptacle 32. Accordingly, the fastener assemblies 16 removably secure the cover 14, and thus the connector 10, to the casing 30 via the receptacle 32.

Figure 3:
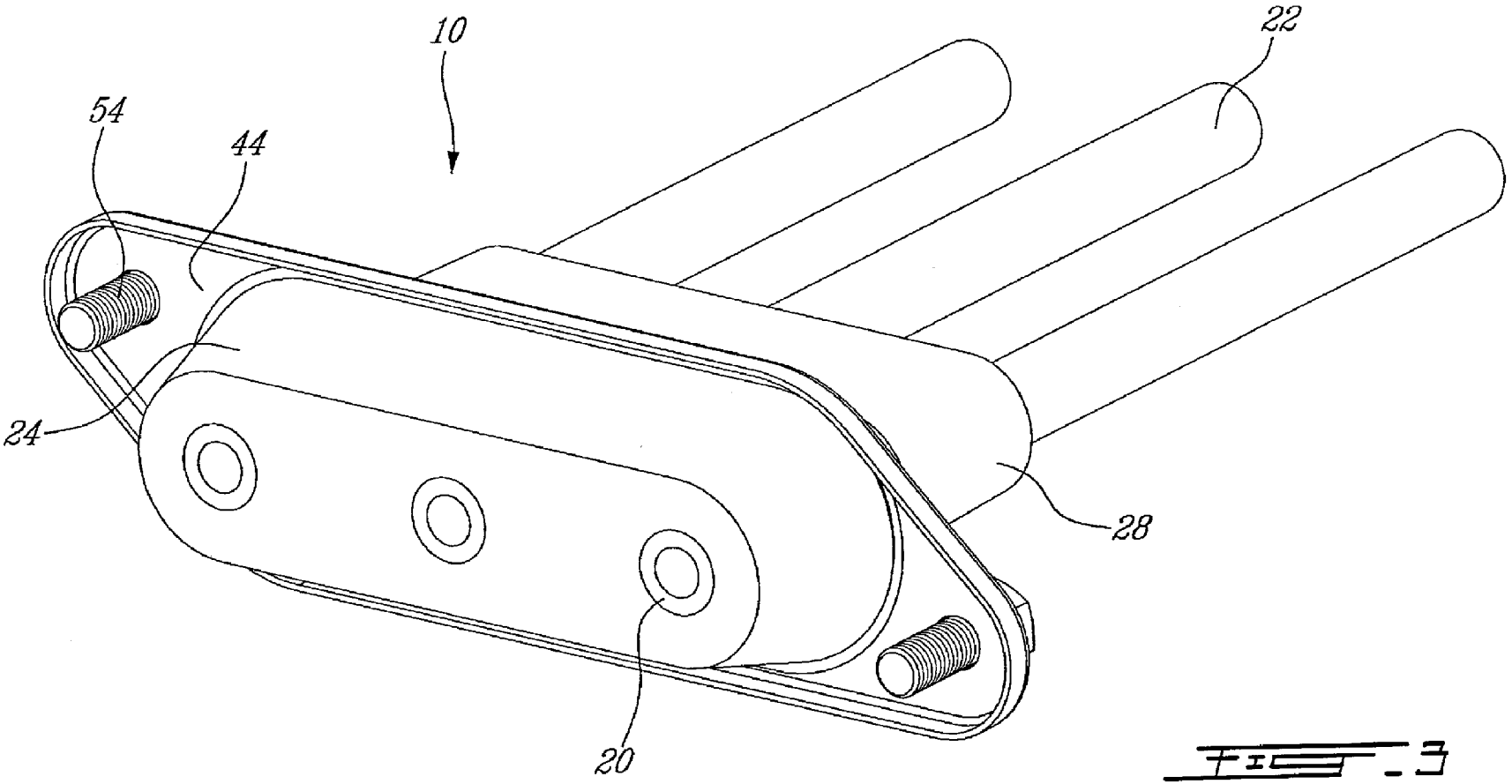
FIG. 3 is a perspective view of the assembled connector of FIG. 1.
Figure 4:
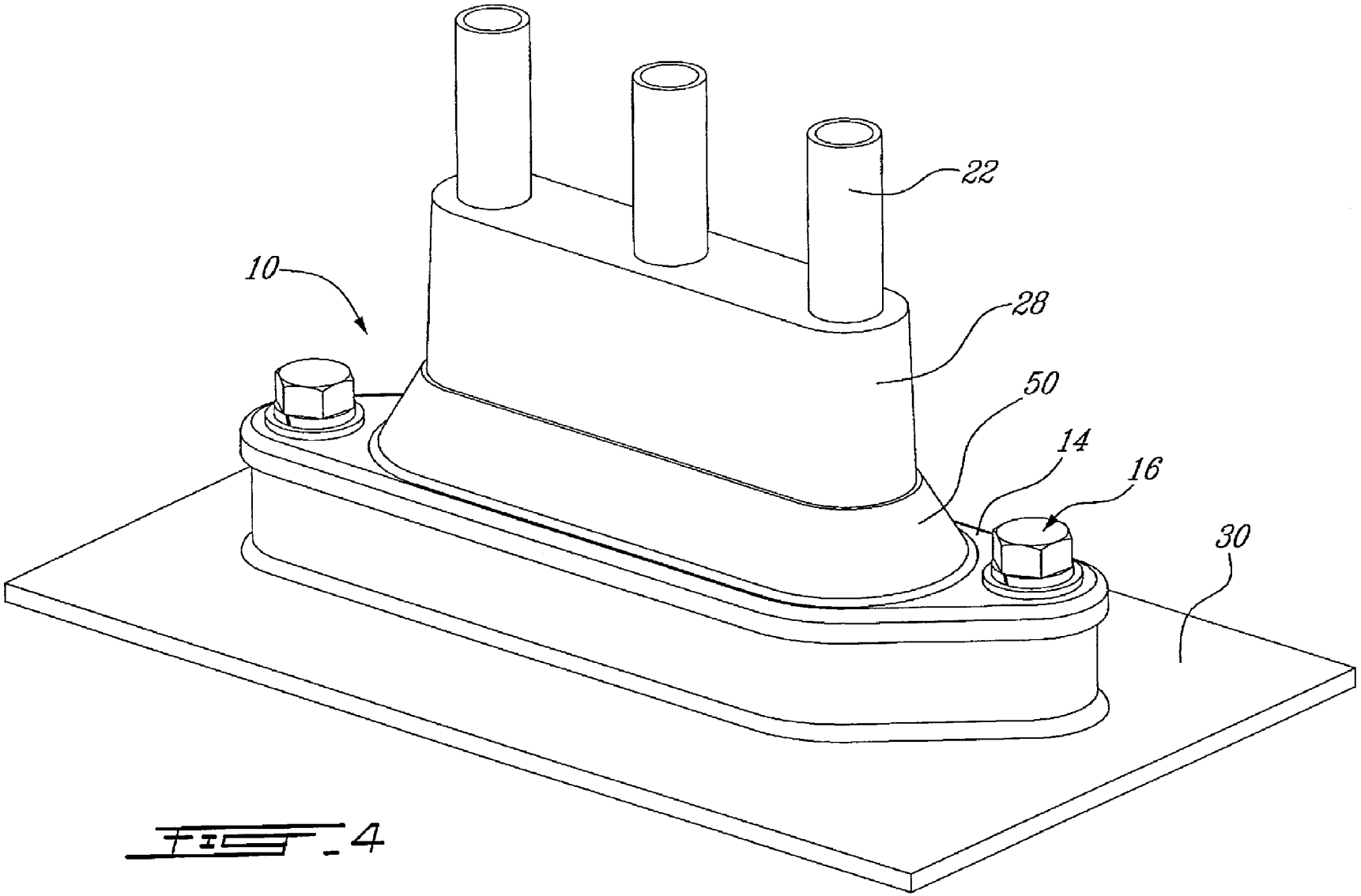
FIG. 4 is a perspective view of the connector of FIG. 3 mounted to a corresponding receptacle of a casing.
Figure 5:
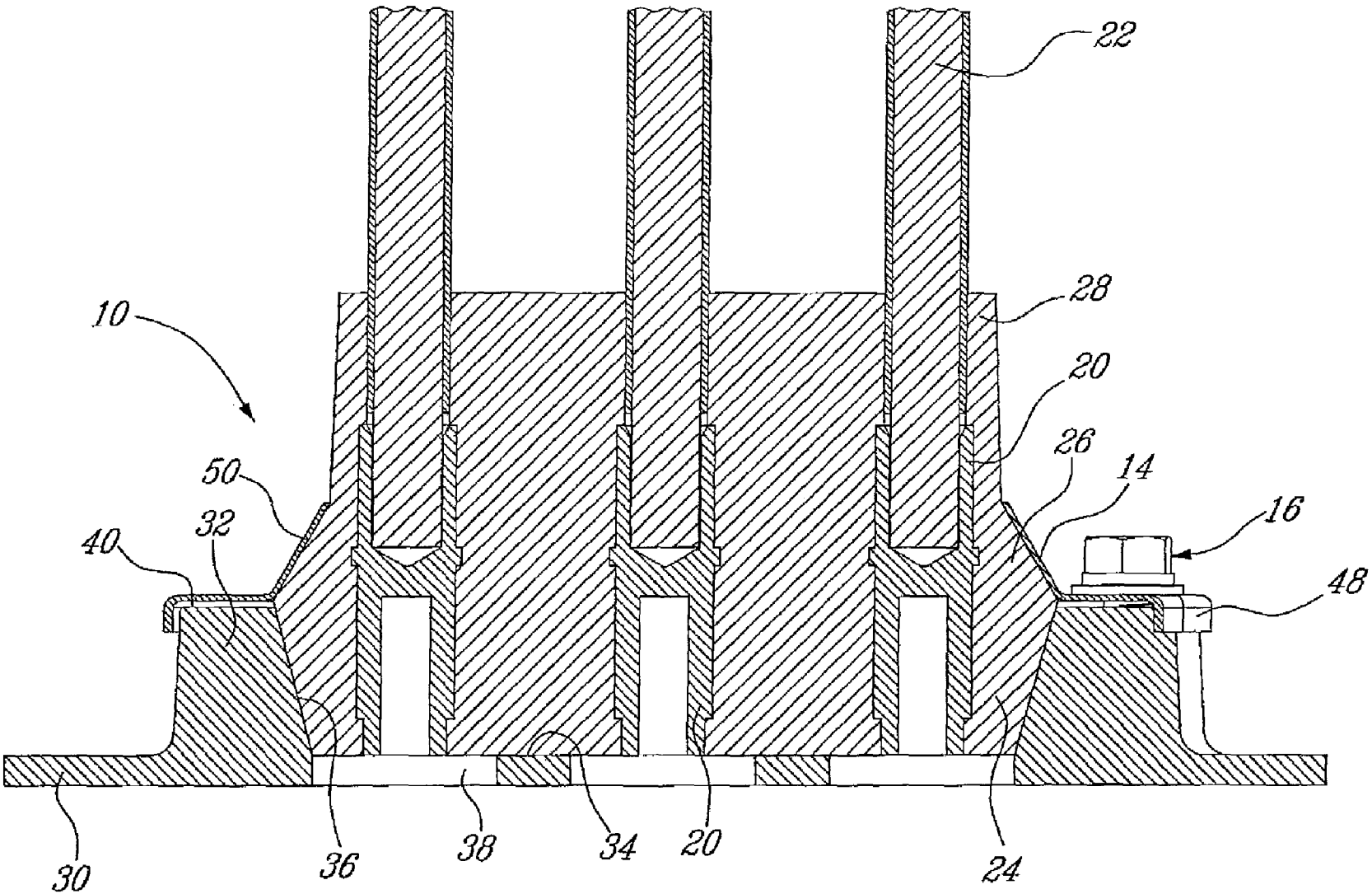
FIG. 5 is a sectional view taken along line 5-5 of FIG. 4.

FIG. 3 shows the connector 10 to which the wires 22 and lugs 20 are mounted. FIGS. 4 and 5 show the connector 10 mounted to the casing 30.

The body 12 is made of a resilient and slightly deformable material such as, for example rubber and various synthetic rubbers. The cover 14 is made of a rigid material such as plastic. In many cases, it is advantageous to shield the wires 22. In such cases, the cover 14 is made of a good electrical conductor to interconnect the shield and the casing 30. For example, copper, brass, stainless steel and aluminium and other alloys can be used. It is to be noted that some alloys can be plated so as to resist the elements in the vicinity of the casing.

While not shown in FIGS. 1 to 5 a braided shield can overlay the cables 22 and be electrically connected to the cover 14.

Turning now to FIG. 5 of the appended drawings, the connector 10 is shown mounted to the casing 30 in a sectional view. As can be seen from this figure, the first taper portion 24 fits the taper wall 36 of the cavity 34 while being compressed therein by the cover 14 which is secured to the flat portion 40 of the receptacle 32 by the fastener assemblies 16. Accordingly, the complementary fit of the two tapered surfaces and the slight compression of the body 12 provide an adequate seal between the body 12 and the receptacle 32.

As can be seen from FIG. 5, the flange 48 surrounds the receptacle 32 to provide a better seal between the connector 10 and the casing 30. The flange 48 also strengthens the cover 14.

It is to be noted that the taper portion 50 of the cover 14 snugly fits the second taper portion 26 of the body 12. The force applied by the cover 14 to the second taper portion 26 when it is fastened to the receptacle 32 compresses the body 12 onto the lugs 20, thereby improving the seal between the body 12 and the lugs 20.

It will be apparent to one skilled in the art that the assembly or the lugs 20 and cables 22 to the body 12 could be done as follows. The lugs 20 are first fixedly mounted and electrically connected to the cables 22 and then the body 12 is moulded over the cables and lugs. A seal is thereby formed between the body 12 and the cables 22.

Figure 6:
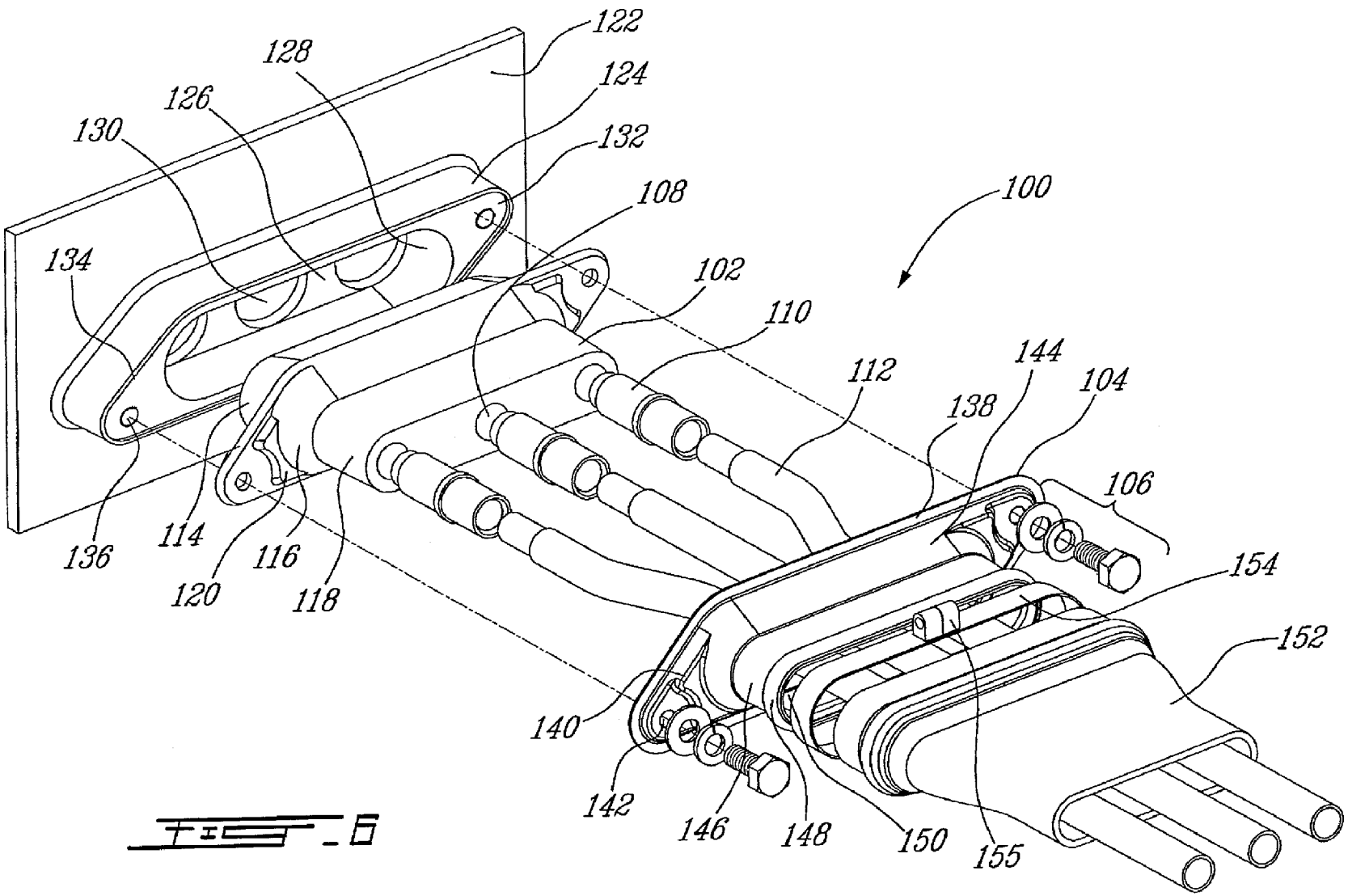
FIG. 6 is an exploded perspective view of a connector according to a second illustrative embodiment of the present invention.
Figure 7:
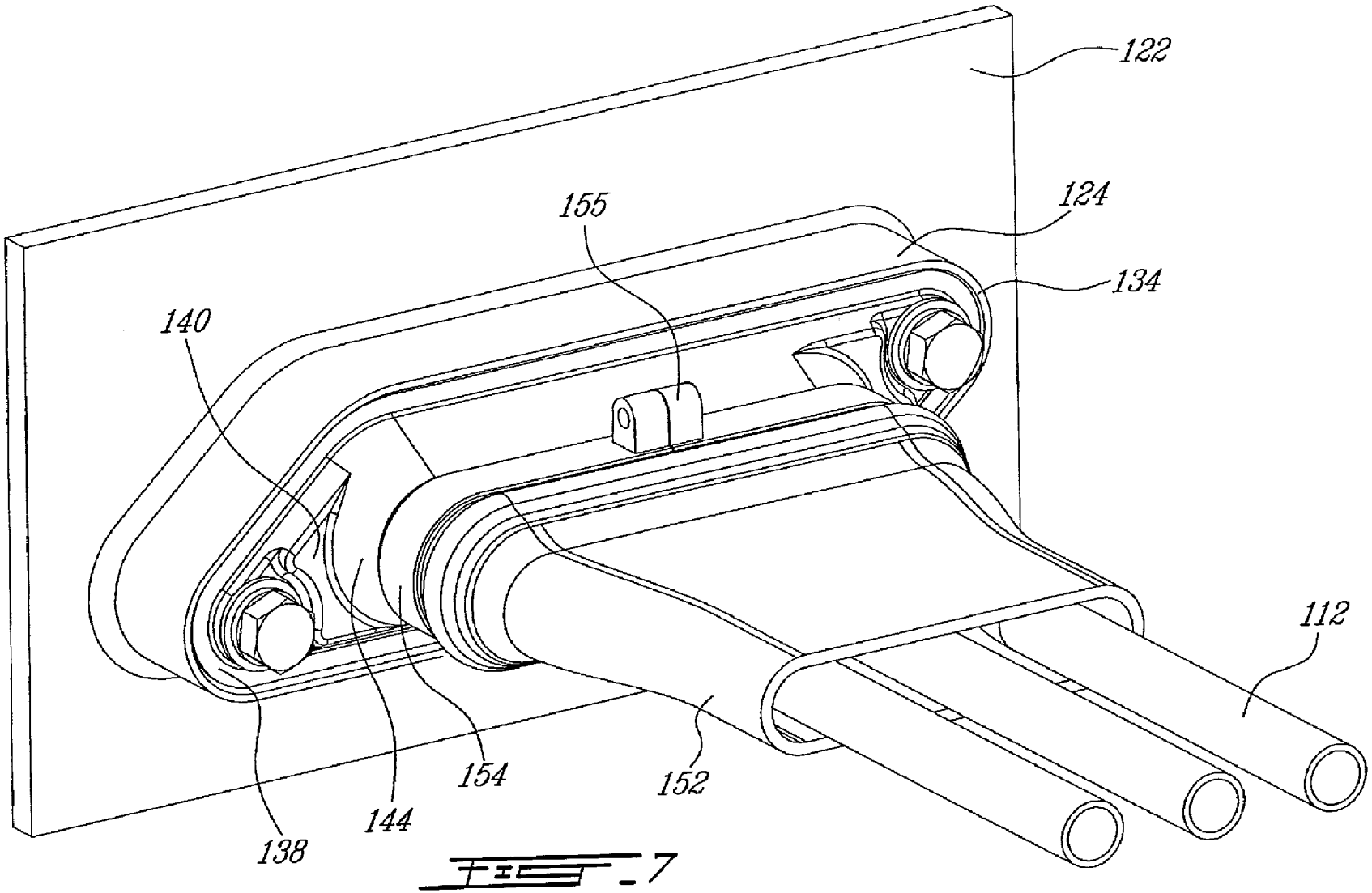
FIG. 7 is a perspective view of the connector of FIG. 6 mounted to a corresponding receptacle of a casing.
Figure 8:
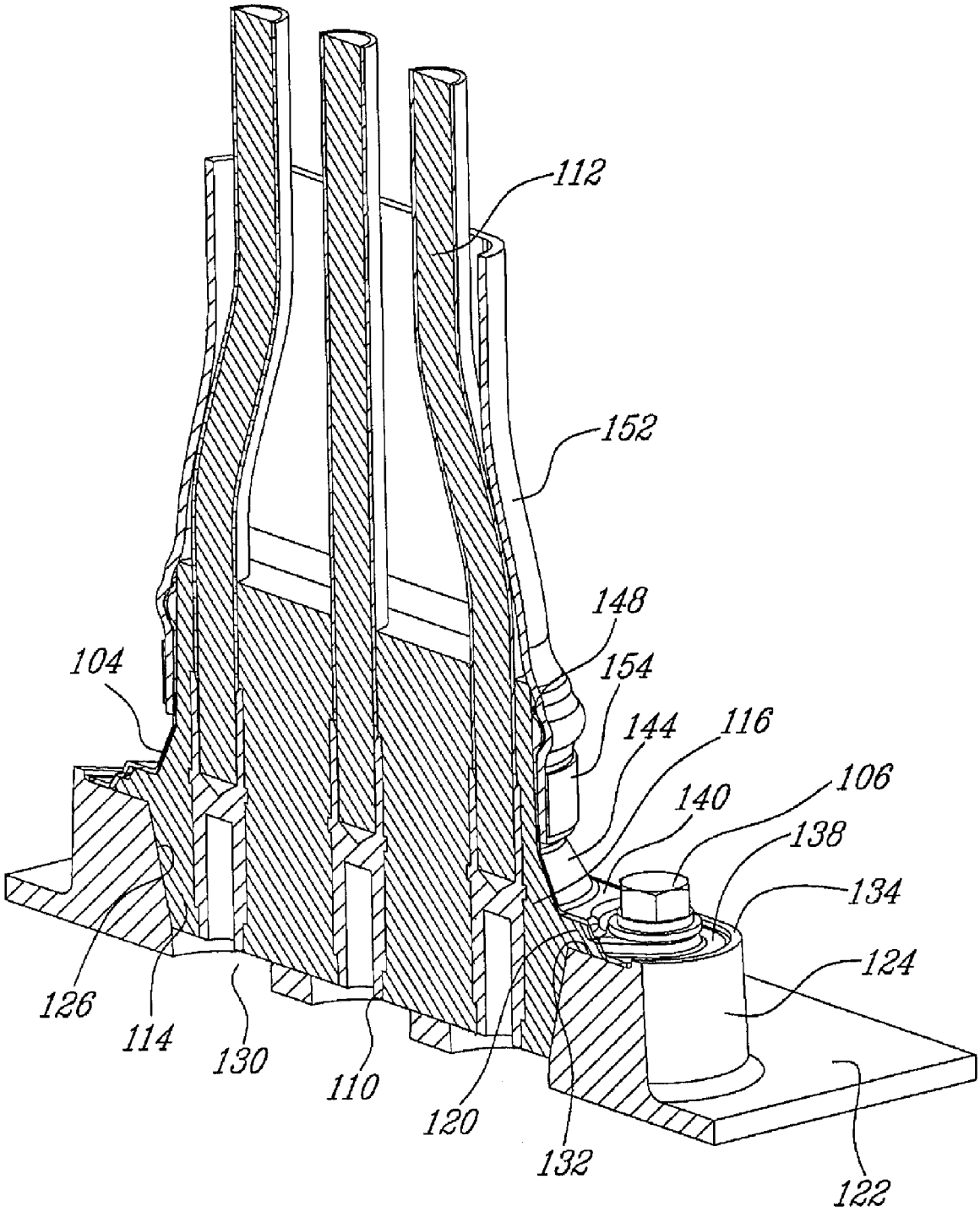
FIG. 8 is a sectional perspective view taken along line 8-8 of FIG. 7.

Turning now to FIGS. 6 to 8 of the appended drawings, a connector 100 according to a second illustrative embodiment of the present invention will be described.

The connector 100 includes a body 102, a cover 104 and two fastener assemblies 106. The body 102 includes three apertures 108 so configured and sized as to snugly receive lugs 110 to which electric wires or cables 112 are fixedly mounted.

In a similar fashion to the body 12 described hereinabove, the body 102 includes a first taper portion 114, a second taper portion 116 and a straight portion 118. The body 102 further includes a peripheral portion 120 located between the first and second taper portions 114 and 116. As will be described hereinbelow, the peripheral portion 120 improves the seal between the body 102 and the casing 122.

The casing 122 includes a receptacle 124 so configured and sized as to receive the first taper portion 114 of the body 102. More specifically, the receptacle 124 includes a cavity 126 provided with a sloping inner wall 128 conforming to the first taper portion 114. The cavity 126 also includes three apertures 130 allowing pins (not shown) therethrough for interconnection with the lugs 110. The receptacle 124 also a flat shoulder 132 surrounded by a thin wall 134 and provided with threaded apertures 136 configured and sized to receive portions of the fastener assemblies 106.

The cover 104 includes a generally flat peripheral portion 138 provided with embossments 140 to fit the peripheral portion 120 of the body 102. The embossments 140 each include an aperture 142 to allow passage of the fasteners 106. One skilled in the art will understand that the embossments 140 strengthen the cover 14.

The cover 104 also includes a taper portion 144 and a generally straight portion 146. The taper portion 144 is so configured and sized as to fit onto the second taper portion 116 of the body 102. The generally straight portion 146 includes a peripheral bulge 148 and an aperture 150 allowing the cables 112 therethrough.

The fastener assemblies 106 are similar to the fastener assemblies 16 described hereinabove and will therefore not be further described herein.

The connector 100 also includes an optional braided shield 152 covering the entire length of the cables 122 and mounted to the straight portion 146 by a strap 154. The strap 154 includes fastening elements 155 allowing its assembly/disassembly. The bulge 148 helps to maintain the strap 154 to the straight portion 146 against eventual pulling action thereon.

FIG. 7 shows the connector 100 mounted to the casing 122.

Turning now to FIG. 8 of the appended drawings, the connector 100 is shown mounted to the casing 122. As can be seen from this figure, the first taper portion 114 fits the taper wall 126 of the receptacle 124 while being compressed therein by the cover 104. The complementary fit of the two tapered surfaces and the slight compression of the body 102 provide an adequate seal between the body 102 and the receptacle 124. As can be seen from this Figure, to provide an even tighter seal between the body 102 and the receptacle 124, the peripheral portion 120 is compressed between the flat shoulder 132 of the receptacle and the embossments 140 of the cover 104.

The thin wall 134 of the receptacle 124 surrounds the flange 138 of the cover 104 to provide a better seal between the connector 100 and the casing 122.

It is to be noted that the taper portion 144 of the cover 104 snugly fits the second taper portion 116 of the body 102. The force applied by the cover 104 to the second taper portion 144 when it is fastened to the receptacle 124 compresses the body 102 onto the lugs 110, thereby improving the seal between the body 102 and the lugs 110.

Figure 9:
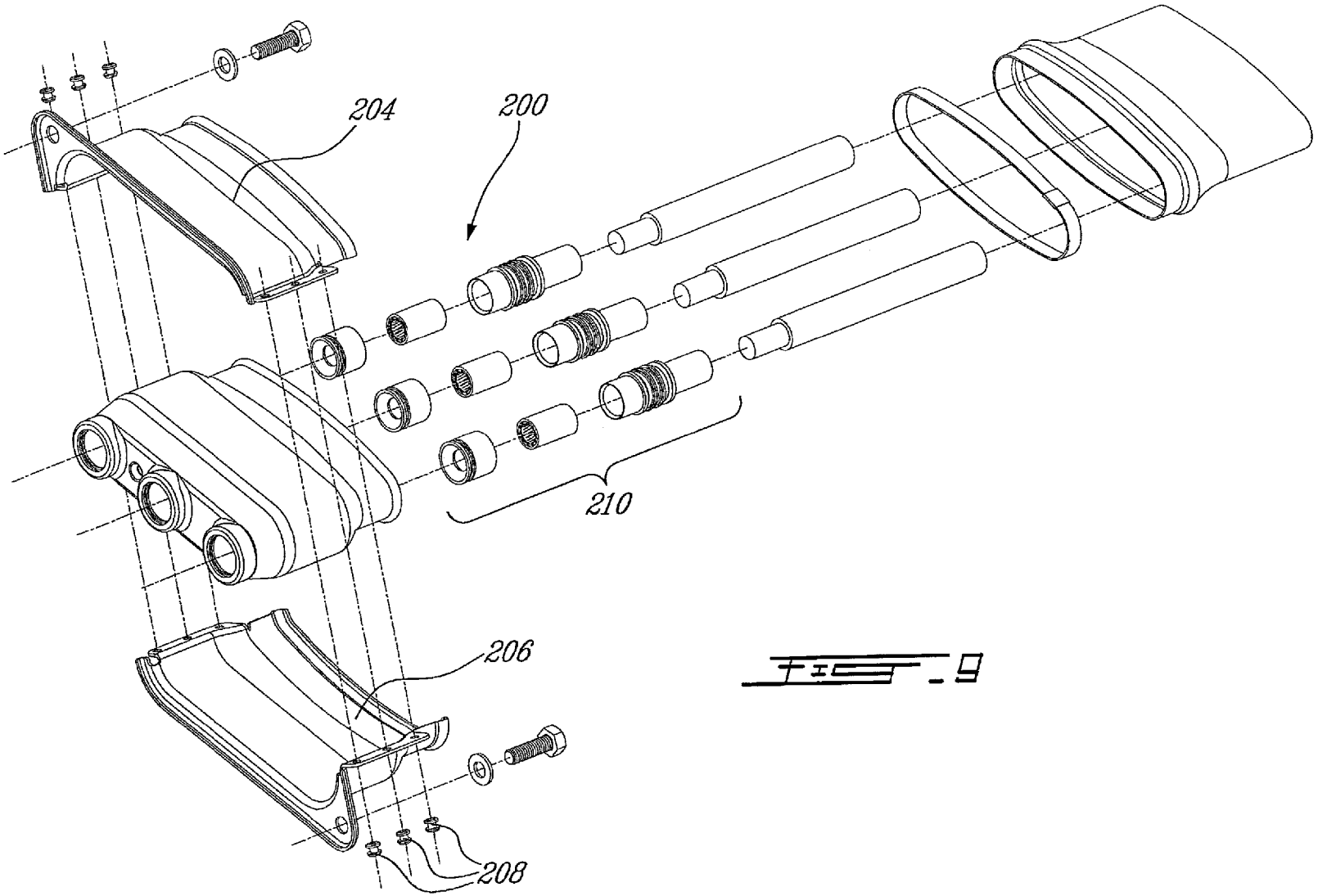
FIG. 9 is an exploded perspective view of a connector according to a third illustrative embodiment of the present invention.

Turning now to FIG. 9 of the appended drawings a connector 200 according to a third illustrative embodiment of the present invention will be described. It is to be noted that since the connector 200 is similar to the connectors 10 and 100 described hereinabove with reference to FIGS. 1 to 8, only the differences between these connectors will be described hereinbelow.

The main difference between the connector 200 and the connectors 10 and 100 is concerned with the cover assembly 202 that is made of two identical cover portions 204 and 206 releasably interconnected b three fasteners 208. As will easily be understood by one skilled in the art, to use a two-portion cover assembly 202 facilitates the fabrication.

It is also to be noted that the lugs 210 used in the connector 200 are in three portions.

It is to be noted that the number and size of the wires mounted to the connectors described herein may vary. Similarly, the shape of the lugs could also vary.

It is also to be noted that the position of the mounting apertures 46 and 146 are such as to allow two such connectors to be provided side by side while minimizing the space required.

As will easily be understood by one skilled in the art, even though the receptacles 32 and 132 are illustrated herein as protruding from the face of the corresponding casing 30 and 122, such receptacles could also be inset in the casing.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of illustrative embodiments thereof, it can be modified, without departing from the spirit, scope and nature of the subject invention.

What is claimed is:

1. An electrical connector to be connected to a receptacle of a casing; the receptacle including a cavity provided with a sloping inner wall, the electrical connector comprising:

a body including at least one aperture to receive a respective electric wire therethrough; a first taper portion and a second taper portion; the first taper portion being configured and sized as to snugly fit in the cavity of the receptacle;

a cover including a flat portion and a taper portion so configured and sized as to fit onto the second taper portion of the body; and at least one fastener assembly configured and sized to removably secure the flat portion of the cover to the casing.

2. An electrical connector as recited in claim 1, wherein the at least one electric wire receiving aperture of the body includes three electric wire receiving apertures.

3. An electrical connector as recited in claim 1, wherein the body further includes a straight portion extending from the second taper portion; the cover including an aperture sized to allow the straight portion of the body therethrough.

4. An electrical connector as recited in claim 3, wherein the cover is further provided with a straight portion configured and sized to cover the straight portion of the body when assembled thereto.

5. An electrical connector as recited in claim 4, wherein the straight portion of the cover includes a peripheral bulge.

6. An electrical connector as recited in claim 5, wherein the cover further includes a removable strap configured and sized as to removably mount a wire shield to the straight portion of the cover.

7. An electrical connector as recited in claim 1, wherein the cover further includes a flange portion at the periphery of the flat portion.

8. An electrical connector as recited in claim 1, wherein the electric wire is provided with a lug configured and sized as to be embedded in the body.

9. An electrical connector as recited in claim 8, wherein the body is molded over the lug.

10. An electrical connector as recited in claim 1, wherein the body further includes a peripheral portion provided between the first and second taper portions, the peripheral portion being configured and sized as to be positioned between the flat portion of the cover and the receptacle when the connector is mounted to the receptacle.

11. An electrical connector as recited in claim 1, wherein the flat portion of the cover is provided with embossments.

12. An electrical connector as recited in claim 1, wherein the at least one fastener assembly includes two fastener assemblies.

13. An electrical connector as recited in claim 1, wherein the cover is made of two identical cover portion each defining a half-cover.

14. An electrical connector as recited in claim 13, wherein the two cover portions are removably mounted to one another via fasteners.

15. An electrical connector as recited in claim 1, wherein the receptacle includes a flat portion configured and sized to receive the flat portion of the cover and surrounded by a thin wall.

* * * * *